US009781801B2

(12) United States Patent
Hoss

(10) Patent No.: US 9,781,801 B2
(45) Date of Patent: Oct. 3, 2017

(54) PERFORMANCE LIGHTING AND CONTROL METHOD

(71) Applicant: Dell Products, LP, Round Rock, TX (US)

(72) Inventor: Shawn P. Hoss, Round Rock, TX (US)

(73) Assignee: Dell Products, LP, Round Rock, TX (US)

( * ) Notice: Subject to any disclaimer, the term of this patent is extended or adjusted under 35 U.S.C. 154(b) by 244 days.

(21) Appl. No.: 14/148,248

(22) Filed: Jan. 6, 2014

(65) Prior Publication Data

US 2015/0195887 A1 Jul. 9, 2015

(51) Int. Cl.

| | |
|---|---|
| ***G08B 5/00*** | (2006.01) |
| ***H05B 33/08*** | (2006.01) |
| *G08B 29/04* | (2006.01) |
| *G08B 21/18* | (2006.01) |
| *G08B 13/196* | (2006.01) |
| *G08B 5/36* | (2006.01) |
| *H05B 37/02* | (2006.01) |

(52) U.S. Cl.

CPC ..... *H05B 33/0863* (2013.01); *G08B 5/36* (2013.01); *G08B 13/19682* (2013.01); *G08B 13/19691* (2013.01); *G08B 21/18* (2013.01); *G08B 29/04* (2013.01); *H05B 37/0281* (2013.01)

(58) Field of Classification Search

CPC ..... G09F 9/33; F21S 8/00; H05B 37/0281; H05B 33/0863; G08B 5/36; G08B 13/19682; G08B 21/18; G08B 13/19691; G08B 29/04

See application file for complete search history.

(56) References Cited

U.S. PATENT DOCUMENTS

| | | | | |
|---|---|---|---|---|
| 4,898,059 | A * | 2/1990 | Iizuka | G10H 1/0041 340/384.5 |
| 5,345,807 | A | 9/1994 | Butts et al. | |
| 5,434,566 | A | 7/1995 | Iwasa et al. | |
| 5,515,040 | A | 5/1996 | Lee et al. | |
| 5,574,858 | A | 11/1996 | Witte | |
| 5,790,102 | A | 8/1998 | Nassimi | |
| 6,098,184 | A | 8/2000 | Patterson, Jr. | |
| 6,107,997 | A | 8/2000 | Ure | |
| 6,135,886 | A | 10/2000 | Armstrong | |
| 6,166,723 | A | 12/2000 | Schena et al. | |

(Continued)

*Primary Examiner* — Joseph Feild
*Assistant Examiner* — Rufus Point
(74) *Attorney, Agent, or Firm* — Prol Intellectual Property Law, PLLC; H. Kenneth Prol

(57) ABSTRACT

The lighting coordinator of an information handling system may associate quantitative values of a state parameter that describes a state of operation of a component of the information handling system with lighting effects. The lighting effect associated with a quantitative value may be indicative of a range of the quantitative value. The lighting coordinator may receive a signal indicative of a quantitative value of the state parameter and may transmit control signals to generate the lighting effect associated with the quantitative value of the state parameter. The lighting coordinator may receive user input to configure the association of quantitative values of the state parameter with the lighting effects. The lighting coordinator may also represent an attribute of a character or other aspect of a video game by another lighting effect. The components may include a CPU and GPU.

20 Claims, 6 Drawing Sheets

(56) References Cited

U.S. PATENT DOCUMENTS 6,587,093 B1 7/2003 Shaw et al.
7,024,625 B2 4/2006 Shali
7,136,045 B2 11/2006 Rosenberg et al.
7,463,163 B2 * 12/2008 Wu ..... G06F 1/16 340/636.1
7,533,371 B1 * 5/2009 Johns ..... G06F 11/323 345/419
7,683,801 B2 * 3/2010 Winarski ..... G08B 5/36 340/815.4
7,710,397 B2 5/2010 Krah et al.
7,817,135 B2 10/2010 Shaw et al.
8,035,616 B2 10/2011 Shaw et al.
8,108,879 B1 * 1/2012 Garlick ..... G06F 9/52 712/43
8,243,018 B2 8/2012 Farag et al.
8,355,257 B2 * 1/2013 Zhang ..... G06T 1/20 361/679.01
8,397,409 B2 * 3/2013 Huang ..... G06F 11/326 340/679
8,766,783 B1 * 7/2014 Hughes ..... H04N 21/25833 340/12.3
8,922,570 B2 * 12/2014 Archer ..... H05B 37/0245 345/204
9,070,174 B2 * 6/2015 Beaulieu ..... G06Q 50/08
9,153,106 B1 * 10/2015 Kuscher ..... G08B 5/36
9,384,113 B1 * 7/2016 Moy ..... G06F 11/325
2002/0075284 A1 * 6/2002 Rabb, III ..... G06T 3/0093 345/646
2002/0080575 A1 * 6/2002 Nam ..... G06F 1/184 361/679.47
2004/0170018 A1 * 9/2004 Nawashiro ..... F21V 5/04 362/244
2004/0198493 A1 * 10/2004 Mattice ..... A63F 13/08 463/42
2004/0257766 A1 * 12/2004 Rasmussen ..... H05K 7/20572 361/689
2005/0040964 A1 * 2/2005 Thomas ..... G11B 33/10 340/815.45
2005/0276053 A1 * 12/2005 Nortrup ..... F21S 48/325 362/294
2006/0033730 A1 * 2/2006 Wu ..... G06F 1/16 345/211
2007/0038742 A1 * 2/2007 Lin ..... H04L 43/0817 709/224
2007/0090964 A1 * 4/2007 You ..... G06F 11/325 340/815.45
2007/0185968 A1 * 8/2007 White ..... H04N 5/4403 709/208
2007/0188427 A1 * 8/2007 Lys ..... H05B 33/0815 345/82
2007/0206375 A1 * 9/2007 Piepgras ..... A43B 1/0027 362/147
2007/0257860 A1 * 11/2007 Langer ..... H05B 33/0818 345/46
2008/0024470 A1 * 1/2008 Andre ..... G09F 9/30 345/204
2008/0030362 A1 * 2/2008 Huang ..... H04L 41/0681 340/815.45
2008/0059702 A1 * 3/2008 Lu ..... G11B 31/00 711/115
2008/0094246 A1 * 4/2008 Yuan ..... G04G 15/006 340/4.35
2008/0284696 A1 * 11/2008 Rosenblatt ..... G02F 1/1336 345/87
2008/0297368 A1 * 12/2008 Winarski ..... G08B 5/36 340/691.1
2009/0140985 A1 6/2009 Liu
2009/0303072 A1 * 12/2009 Gilling ..... G08B 5/36 340/815.45
2010/0127983 A1 5/2010 Irani et al.
2010/0141692 A1 * 6/2010 Winarski ..... G08B 5/36 345/690
2010/0148999 A1 6/2010 Casparian et al.
2010/0164736 A1 * 7/2010 Byers ..... H04L 12/12 340/657
2010/0201626 A1 8/2010 Krah et al.
2010/0321301 A1 12/2010 Casparian et al.
2011/0019420 A1 * 1/2011 Kadotani ..... F21V 29/74 362/249.03
2011/0128166 A1 * 6/2011 Kagami ..... G06F 3/0233 341/22
2011/0249010 A1 * 10/2011 Lonkar ..... G06T 1/20 345/506
2011/0273833 A1 * 11/2011 Zhang ..... G06T 1/20 361/679.32
2011/0298962 A1 * 12/2011 Shiohara ..... H04N 5/23235 348/333.02
2012/0020108 A1 * 1/2012 Chang ..... G02B 6/0011 362/555
2013/0127611 A1 * 5/2013 Bernstein ..... G08B 21/18 340/455
2013/0155081 A1 * 6/2013 Khodorkovsky ..... G06F 1/3206 345/522
2013/0262890 A1 * 10/2013 Marshall ..... G06F 1/3212 713/320
2014/0111029 A1 * 4/2014 Gutteridge ..... H01H 83/06 307/126
2014/0118155 A1 * 5/2014 Bowers ..... G06F 11/328 340/815.45
2014/0169751 A1 * 6/2014 Weast ..... H04N 5/76 386/200
2014/0215462 A1 * 7/2014 Kuo ..... G06F 9/45533 718/1
2015/0316595 A1 * 11/2015 Creekmore ..... H01H 9/181 324/103 R

* cited by examiner

PERFORMANCE LIGHTING AND CONTROL METHOD

FIELD OF THE DISCLOSURE

The present disclosure generally relates to information handling systems, and more particularly relates to indicating an operating status of components of information handling system via displays of lights on the information handling system.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Information handling systems may indicate an operating status of components via displays of lights on the information handling systems.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
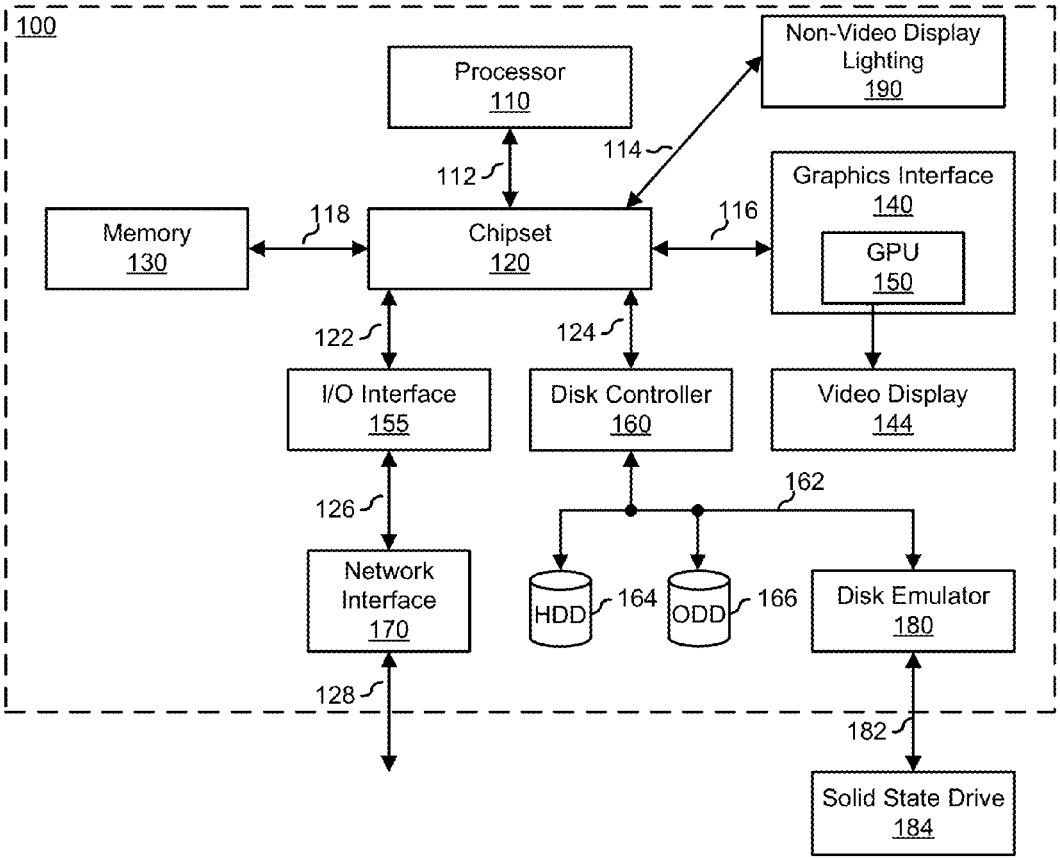
FIG. 1 is a block diagram illustrating an information handling system according to an embodiment of the present disclosure.

FIG. 1 illustrates a block diagram of an exemplary embodiment of an information handling system, generally designated at 100. The information handling system 100 can include a physical processor 110 coupled to chipset 120 via host bus 112. Other embodiments may include additional processors coupled to a chipset. In further embodiments, each processor may be connected to the chipset via a separate host bus. In these embodiments, the chipset may support multiple processors and can allow for simultaneous processing of multiple processors and support the exchange of information within an information handling system during multiple processing operations.

According to one aspect, the chipset 120 can be referred to as a memory hub or a memory controller. For example, the chipset 120 can include an Accelerated Hub Architecture (AHA) and can include a memory controller hub and an input/output (I/O) controller hub. As a memory controller hub, the chipset 120 can function to provide access to physical processor 110 using the host bus. The chipset 120 can also provide a memory interface for accessing memory 130 using memory bus 118. In a particular embodiment, the memory bus 118 and the host bus 112 can be individual buses or part of the same bus. The chipset 120 can also provide bus control and can handle transfers between the buses when there are multiple buses.

According to another aspect, the chipset 120 can be generally considered an application specific chipset that provides connectivity to various buses, and integrates other system functions. For example, the chipset 120 can be provided using an Intel® Hub Architecture (IHA) chipset that can also include two parts, a Graphics and AGP Memory Controller Hub (GMCH) and an I/O Controller Hub (ICH). For example, an Intel 820E, an 815E chipset, or any combination thereof, available from the Intel Corporation of Santa Clara, Calif., can provide at least a portion of the chipset 120. The chipset 120 can also be packaged as an application specific integrated circuit (ASIC).

The information handling system 100 can also include a graphics interface 140 that can be coupled to the chipset 120 using bus 116. In one form, the graphics interface 140 can be a Peripheral Component Interconnect (PCI) Express interface to display content within a video display 144. Other graphics interfaces may also be used. The graphics interface 140 can provide a video display output to the video display 144. The video display 144 can include one or more types of video displays such as a flat panel display (FPD) or other type of display device. In some embodiments, information handling system 100 may be a video game controller and video display 144 may be a television console.

The information handling system 100 can also include an I/O interface 155 that can be connected via I/O bus 122 to the chipset 120. The I/O interface 155 and I/O bus 122 can include industry standard buses or proprietary buses and respective interfaces or controllers. For example, the I/O bus can also include a PCI bus or a high speed PCI-Express bus. PCI buses and PCI-Express buses can be provided to comply with industry standards for connecting and communicating between various PCI-enabled hardware devices. Other buses can also be provided in association with, or independent of, I/O bus 122 including, but not limited to, industry standard buses or proprietary buses, such as Industry Standard Architecture (ISA), Small Computer Serial Interface (SCSI), Inter-Integrated Circuit (I2C), System Packet Interface (SPI), or Universal Serial buses (USBs).

In an alternate embodiment, the chipset 120 can be a chipset employing a Northbridge/Southbridge chipset configuration (not illustrated). For example, a Northbridge portion of the chipset 120 can communicate with the processor 110 and can control interaction with the memory 130, the I/O bus that can be operable as a PCI bus, and activities for the graphics interface 140. In many embodiments, graphics interface 140 may be a separate graphics card. Graphics interface 140 includes graphics processing unit 150.

The Northbridge portion can also communicate with the processor 110 using the host bus. The chipset 120 can also include a Southbridge portion (not illustrated) of the chipset 120 and can handle I/O functions of the chipset 120. The Southbridge portion can manage the basic forms of I/O such as Universal Serial Bus (USB), serial I/O, audio outputs, Integrated Drive Electronics (IDE), and ISA I/O for the information handling system 100.

The information handling system 100 can further include a network interface 170 connected to I/O interface 155 via bus 126. In a particular embodiment, bus 126 and I/O bus 122 can be individual buses or part of the same bus. The network interface 170 can provide connectivity to a network 128, e.g., a wide area network (WAN), a local area network (LAN), wireless network (IEEE 802), or other network. The network interface 170 may also interface with macrocellular networks including wireless telecommunications networks such as those characterized as 2G, 3G, or 4G or similar wireless telecommunications networks similar to those described above. The network interface 170 may be a wireless adapter having antenna systems for various wireless connectivity and radio frequency subsystems for signal reception, transmission, or related processing.

The information handling system 100 can further include a disk controller 160 connected to chipset 120 via bus 124. In a particular embodiment, bus 124 and host bus 112 can be individual buses or part of the same bus. Disk controller 160 can include a disk interface 162 that connects disc controller 160 to one or more internal disk drives such as a hard disk drive (HDD) 164 and an optical disk drive (ODD) 166 such as a Read/Write Compact Disk (R/W CD), a Read/Write Digital Video Disk (R/W DVD), a Read/Write mini-Digital Video Disk (R/W mini-DVD), or other type of optical disk drive. Disk controller 160 is also connected to disk emulator 180. An example of disk interface 162 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 180 permits a solid-state drive 184 to be coupled to information handling system 100 via an external interface 182. An example of external interface 182 includes a USB interface, an IEEE 1394 (Firewire) interface, a proprietary interface, or a combination thereof. Alternatively, solid-state drive 184 can be disposed within information handling system 100.

The disk drive units 164 and 166 and solid state drive 184 may include a computer-readable medium in which one or more sets of instructions such as software can be embedded. Further, the instructions may embody one or more of the methods or logic as described herein. In a particular embodiment, the instructions may reside completely, or at least partially, within memory 130 and/or within processor 110 during execution by the information handling system 100. Memory 130 and processor 110 also may include computer-readable media.

Information handling system 100 also includes non-video display lighting 190 connected to chipset 120 via bus 114. Non-video display lighting 190 may include one or more lighting units on information handling system 100 in addition to the lighting that may be generated through video display 144. A lighting unit may be a single light or a combination of lights working together. The one or more lighting units of non-video display lighting 190 may include LED lights on the case of information handling system 100, backlighting of portions of a keyboard or touchpad of information handling system 100, lighted icons, a lighted insignia, and other light sources. In some embodiments, the lights may include light bars. A light bar may include two LEDs connected with a light tube. The light tube may enable the distribution of light over its length. It may contain a reflective lining to cause light entering one end to reflect though the tube until it reaches the other end. The distribution may be approximately equal among its length, or controlled light leakage may provide a greater intensity at some portions. In either case, the light diffuses along the tube.

The non-video display lighting 190 generates lighting effects that may indicate the operational state of components of information handling system 100. The components may include a fan, a power supply, processor 110, GPU 150, graphics interface 140, and network interface 170. In some embodiments, the lighting effects may vary to provide a quantitative representation of the state of the components.

Quantitative information may be gathered about the components, and the lighting effects may be varied to represent that quantitative information. The quantitative information may include the values of parameters of the components. For example, quantitative information may include parameters such as fan speed, power draw of a component, ambient temperature of the information handling system 100 as a whole or a component such as processor 110 or GPU 150, the power use of processor 110 or GPU 150, or the load on network interface 170, processor 110 or GPU 150. In some cases, the load may be based upon the amount of throttling of processor 110 or GPU 150. Throttling refers to dynamically adjusting the frequency of operational cycles of a component. In many instances, the frequency may be reduced to save on power consumption or limit heat generation. The load on processor 110 may also be represented by its state; for instance, whether it is in turbo mode; whether it is throttling; or whether there is a pre-hot signal. It may also be represented by the value of a parameter, such as percentage of use, number of threads, percentage of maximum frequency, or number of processes. Other measures of performance may include power draw or whether there is a churning signal. The performance of network interface 170 may be measured by the bandwidth, such as Gbytes/sec.

In some embodiments, information handling system 100 may include system management units and sensors to obtain the quantitative information. A sensor, such as an application-specific integrated circuit, may be inserted into a component to measure power draw. A thermistor may measure temperature. A thermistor is a type of resistor whose resistance varies significantly with temperature. In some cases, the resistance of a thermistor over a particular temperature range is designed to more accurately measure the temperature than a more general-purpose resistor. In some embodiments, a processor such as processor 110 may report quantitative information such as disk I/O status, bandwidth status, processor utilization, and battery power level. In other embodiments, controllers of the components of information handling system 100 may report the quantitative information. In a few embodiments, the temperature of GPU 150 may be reported by a signal from a graphics driver (not shown in FIG. 1). In many embodiments, system management functions performed pursuant to Operating System-directed configuration and Power Management (OSPM) may obtain information about and report on power consumption and component configuration. In many embodiments, the OSPM reports may be made to an operating system.

Variations in the lighting effects to represent the quantitative information may include changes in the lighting intensity of one or more lights of non-video display lighting 190, changes in the color of one or more lights, or changes in the patterns of the light displays. In some embodiments, the lights may represent the states of multiple components. In some further embodiments, separate lights may represent separate components. In other further embodiments, some lights may be used to represent multiple components. The lights may, for example, alternate between indicating the state of two components. A level of brightness of one color may indicate a state of one component, and a level of brightness of another color may indicate a state of a second component.

In many embodiments, information handling system 100 may receive data from a user through I/O interface 155 about the representation of the state of operation of components of information handling system by changes in lighting effects. The user may specify the lights, colors, intensity, and patterns of lighting to represent various states of the components. The user may, for example, specify ranges of quantities and the specific effects for each range. The user may, for example, specify that a particular hue represents a particular range of temperatures of processor 110. In other embodiments, the user may specify a range of effects to match a range of conditions. As the bandwidth varies from BW1 to BW2, for example, the intensity varies from a first intensity to a second intensity. In further embodiments, information handling system 100 may contain one or more packages mapping the state of operation of components to lighting effects. The packages may be groups of default settings. A user may edit them as desired and may create additional packages.

Embodiments of FIG. 1 may enhance the experience of video gamers. Gamers may operate their computers at their limits. Consequently, it may be important to them to have some knowledge of the state of operation of their computers. Because screen space may be devoted to the games, it would be useful to them to be informed of the state of operation by lighting effects other than on screen space. In some embodiments, the lighting effects may represent both the state of a game and the state of operation of components of an information handling system. Backlighting may, for example, change from white to deepening red as a character takes damage, or the pulsing of lights may slow when a character's hit points are running low. At the same time, intensity of that lighting, in separate lighting effects, may indicate a rise in GPU or graphics heating or power draw.

Figure 2:
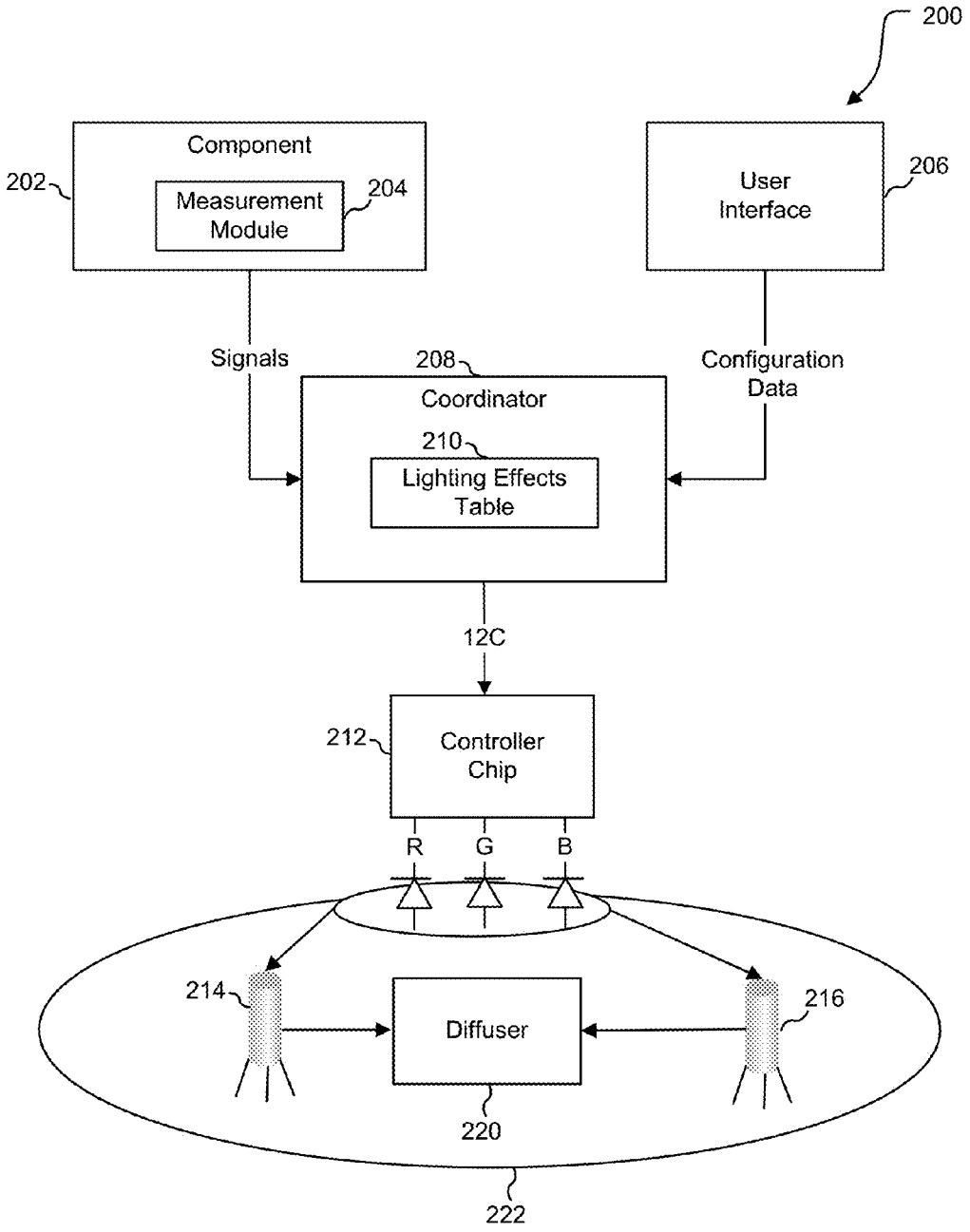
FIG. 2 is a block diagram of an architecture to represent a state of operation of a component of an information handling system with lighting effects.

FIG. 2 shows a portion 200 of an information handling system, such as information handling system 100 of FIG. 1, that represents a state of operation of a component by lighting effects. FIG. 2 includes component 202, user interface 206, coordinator 208, controller chip 212, and lighting unit 222. Lighting unit 222 is an example of non-video display lighting 190 described in FIG. 1. Component 202 may be stressed in the operation of an application. Accordingly, a user may desire to receive a representation of the state of operation of component 202. Measurement module 204 of component 202 may measure or otherwise obtain information on the state of operation of component 202.

Coordinator 208 may receive from component 202 signals about the state of operation of component 202. The signals may indicate the value of a parameter that describes the operation of component 202. It may also receive from a user through user interface 206 configuration data used to describe the representation of the state of operation of component 202 with lighting effects. As an example, temperature is one parameter to describe the state of operation of an information handling systems. The configuration data may specify that as the temperature increases, for example, the color of a lighting unit may move from the cool colors (bluish white) to the warm colors (yellowish white through red). Lighting effects table 210 may describe a mapping between particular states of operation and particular lighting effects. Based upon the signals received from component 202 and the configuration data received from user interface 206, coordinator 208 may send signals to controller chip 212 over the I2C bus to generate lighting effects in lighting unit 222 to represent the state of operation of component 202. In some embodiments, coordinator 208 may be implemented as a processor separate from a main processor, such as processor 110 of FIG. 1. In further embodiments, coordinator 208 may be implemented as an application-specific integrated circuit (ASIC).

An I2C bus may connect two devices or components through two two-directional lines. Upon receipt of signals from coordinator 208, controller chip 212 may in turn generate and transmit signals to control lighting unit 222. In some embodiments, controller chip 212 may operate as a pulse-width modulation (PWM) current driver. A PWM current driver may control the intensity of lighting by rapidly varying the duty cycle and power sent to a light. In some embodiments, controller chip 212 may control the current sent to LED 214 and LED 216 of lighting unit 222 separately.

Lighting unit 222 includes LEDs 214 and 216 and diffuser 220. Diffuser 220 may consist of a light bar that enables the distribution of light from one of LED 214 and 216 along its length to the other LED. Each of LED 214 and 216 may be capable of displaying multiple colors. The signals sent to lighting unit 222 from controller chip 212 may specify the red, green, and blue components of a color (RGB). In some embodiments, however, other color spaces may be used, such as CMYK (cyan, magenta, yellow, and black), CIE (Commission Internationale de l'Eclairage or International Commission on Illumination) XYZ, CIELUV (CIE 1976 (L*, u*, v*) color space), and CIELAB (CIE L, a, b, space).

In addition to controlling the colors and intensities displayed by lighting unit 222, coordinator 208 may control effects produced by the lighting unit 222, such as morphing, pulsing, fading, bleeding, and blinking at various rates. Morphing involves cycling between two designated colors. In pulsing, lights flash on and off at a set tempo. In bleeding, a color may start at one end of a light bar and travel through a light tube to the other end. When the color reaches the other end, an LED at that end may be set to the color, so that the whole tube displays that color uniformly. Thus, the colors, intensity, and lighting effects of lighting unit 222 may change in response to changes in the state of operation of component 202.

In other embodiments, an information handling system may have multiple lighting units of a variety of types, such as light bars, LEDs unconnected to light bars, and backlighting mechanisms. In some of those embodiments, coordinator 208 may control all of the lighting effects of the multiple lighting units. In some further embodiments, each lighting unit may be controlled by a separate controller chip. In many embodiments, the lighting effects generated on an information handling systems used for video games may reflect the state of the video games as well as the state of operation of components of the information handling system.

Figure 3:
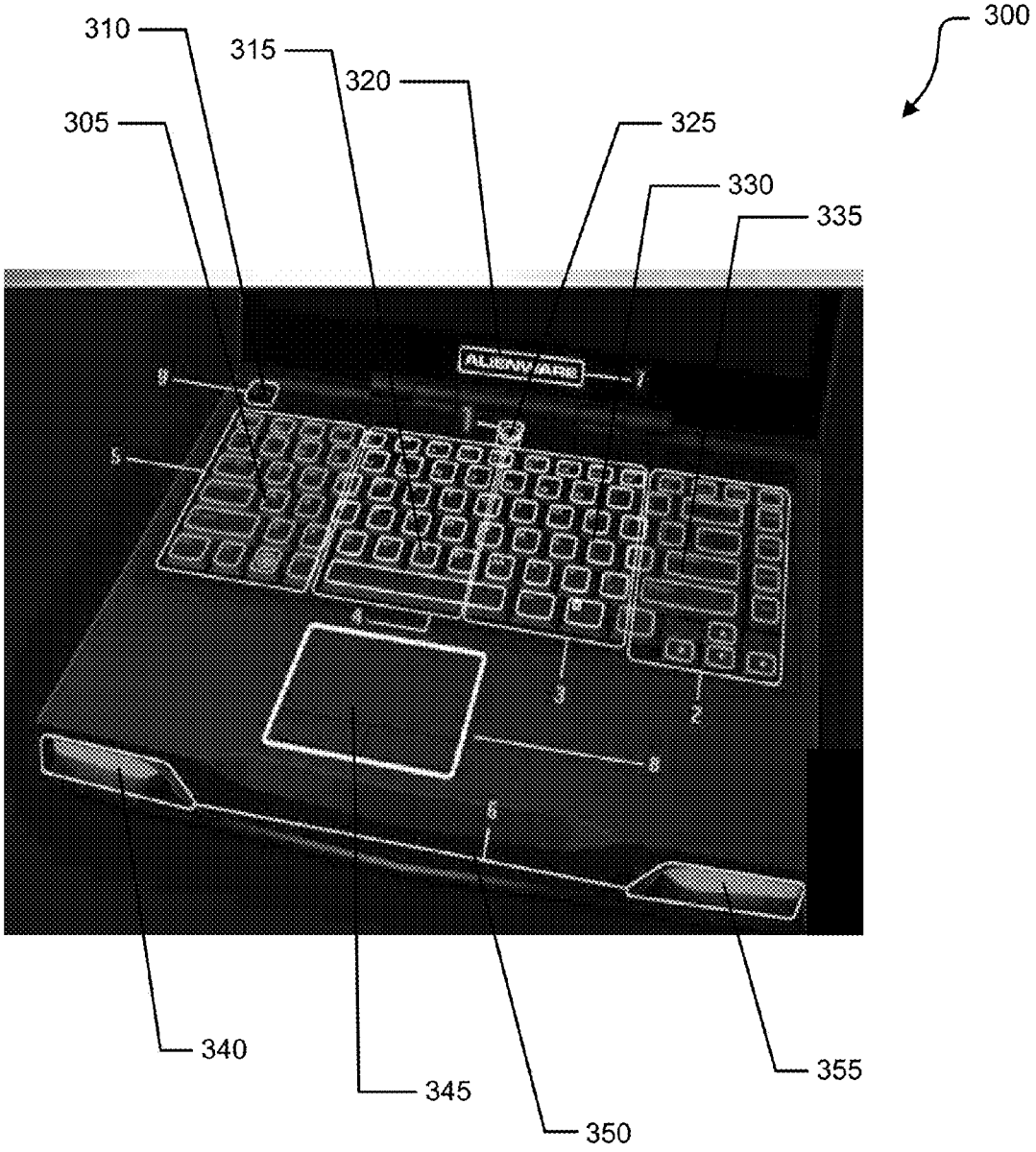
FIG. 3 is an illustration of the placement of lighting units capable of representing a state of operation of a component of an information handling system.

FIG. 3 shows lighting units 305-355 on an example information handling system 300, such as an Alienware® laptop. In the current disclosed embodiments, lighting units 305-355 are controlled with lighting effects capable of indicating a state of operation of the components of information handling system 300. The lights on this example Alienware laptop may be divided into zones, which may be separately controlled. Nine zones are illustrated in FIG. 3. Lights 305, 315, 330, and 335 are backlighting on the keyboard. The keyboard lights comprise four separate zones. Lights 310 and 325 are Alienware badges located beyond the keyboard towards the hinge of the laptop. Light 310 is located on the left side of the laptop and light 325 is located at the center of the laptop. Light 320 is a logo below the screen.

Light 345 is backlighting on a touchpad. Lights 340, 350, and 355 light the front edge. Two LEDs, lights 340 and 355 are joined by light bar 350. In some embodiments, a user may configure the lighting effects displayed by some zones to indicate the state of operation of components of information handling system 300 and may configure the lighting effects displayed by other zones to illustrated the state of video games. In other embodiments, other arrangements of lights and other types of lights may be placed upon an information handling system.

Figure 4A:
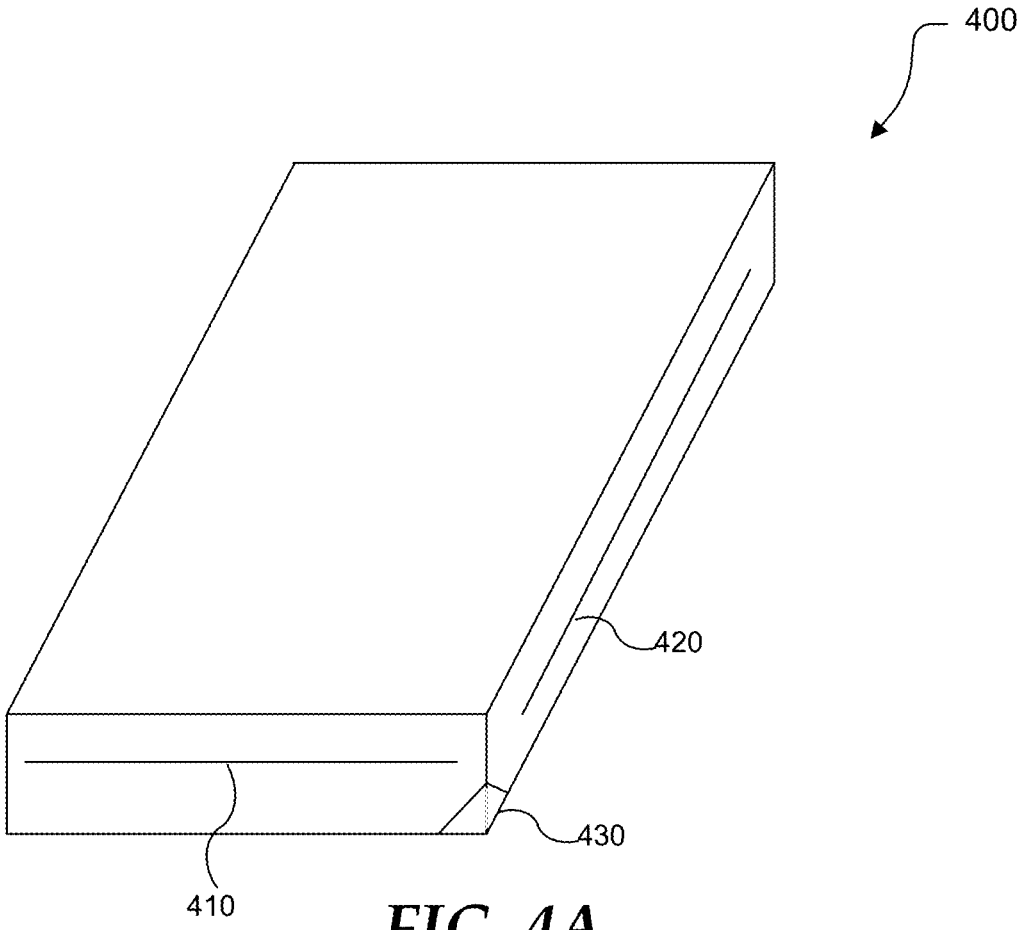
FIGS. 4A and 4B are further illustrations of the placement of lighting units capable of representing a state of operation of a component of an information handling system.
Figure 4B:
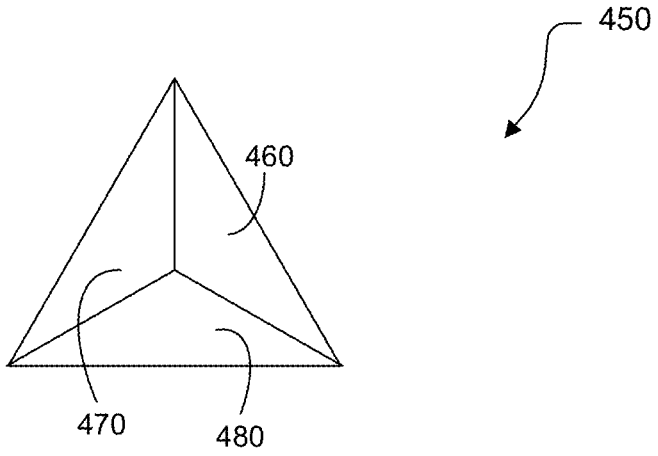

FIGS. 4A and 4B show the placement of lights on another example information handling system 400 such as a compact desktop system. In FIG. 4A, lights 410 and 420 form lines on the case. In some embodiments, the lines may be light bars. Cutout 430 is a triangle formed by a cut-out on the case of information handling system 400. A detailed view is shown in FIG. 4B. Triangle 450, which may be formed by a cut-out from a case of an information handling systems, holds triangles of light 460, 470, and 480. In many embodiments, the triangles of light 460, 470, and 480 may used to represent the state of different components. Triangle 460 may represent an ambient temperature, triangle 470 may represent a frame rate, and triangle 480 may represent processor use. Line 410 may also represent ambient temperature. Line 420 may also represent frame rate. In other embodiments, lights may be included on other portions of an information handling system or lights shown in FIGS. 3, 4A, and 4B may be omitted. In addition, in other embodiments, other types of lights may be used on an information handling system. One of skill can appreciate that multiple combinations of lighting effects and state of operation indications are contemplated. Many types of lighting units may be used as well.

Figure 5:
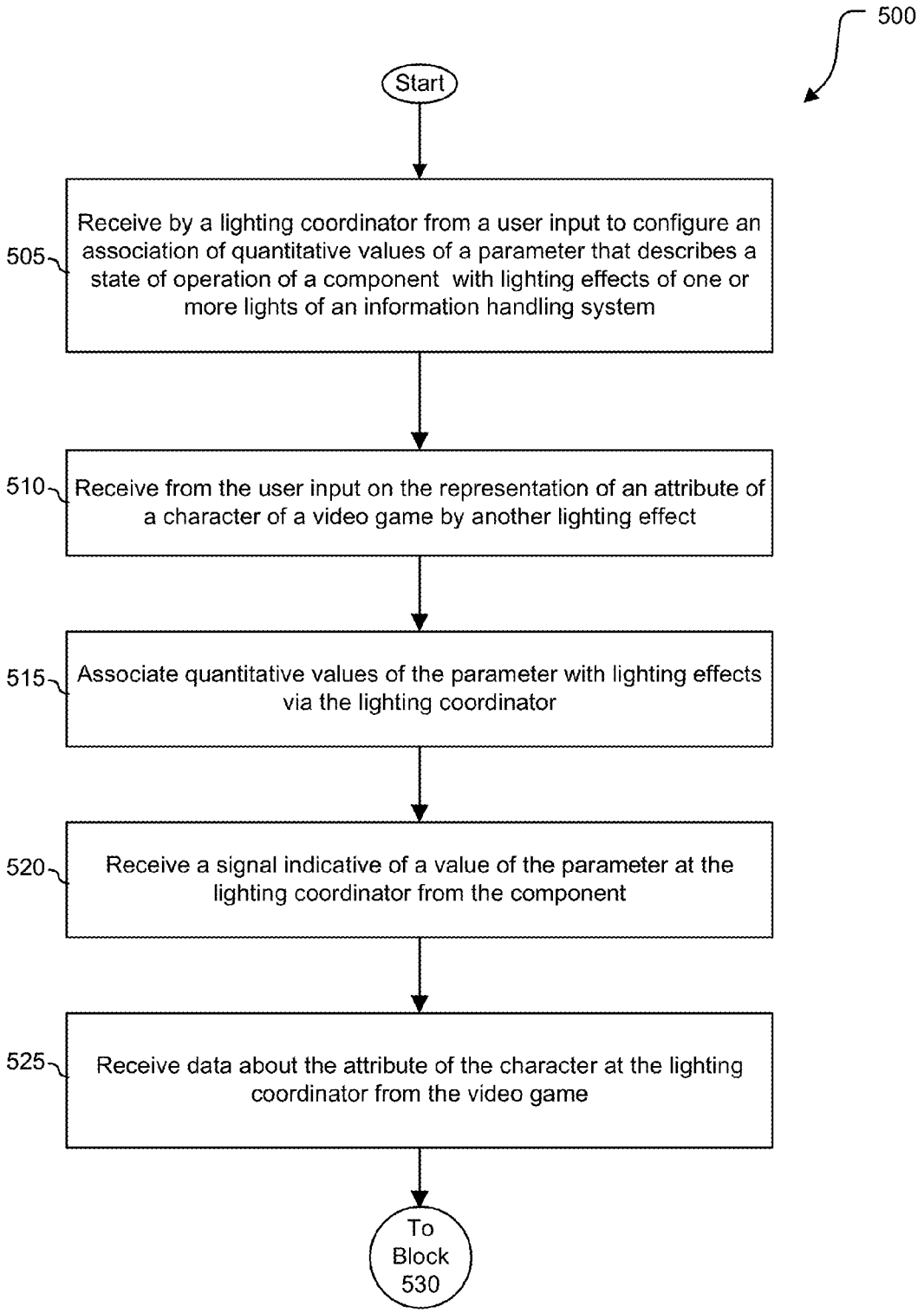
FIG. 5 is a flowchart illustrating a method according to an embodiment of the disclosure.
Figure 5:
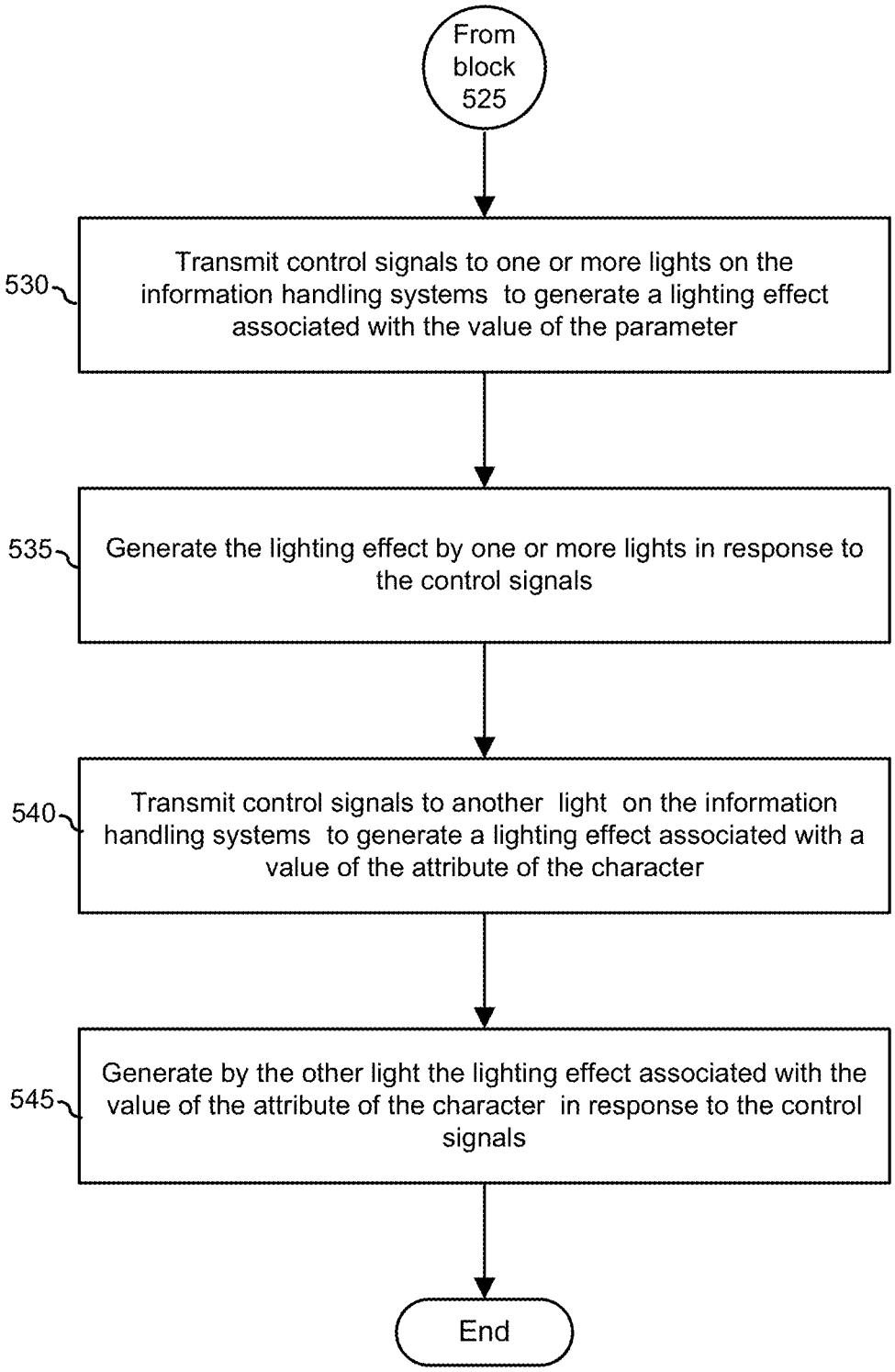

FIG. 5 is a flowchart of a method 500 of representing quantitative values of parameters that describe states of operation of components of an information handling system with lighting effects of one or more lights of the information handling system. The information handling system may be an information handling system such as information handling system 100 of FIG. 1, and the lights may be lights such as those depicted in FIGS. 3, 4A, and 4B. Method 500 begins at block 505 with a lighting coordinator, such as coordinator 208 of FIG. 2, receiving input from a user to configure an association of quantitative values of a parameter that describes a state of operation of a component of the information handling system with lighting effects of one or more lights of the information handling system. The component may be a processor or CPU, such as processor 110 of FIG. 1; a graphics processor such as GPU 150 of FIG. 1; memory, such as memory 130 of FIG. 1; a power supply; a fan; or other component of an information handling system that may be stressed by a particular application, such as a game. The lighting effects may include a morphing or rapid switching of colors, of one or more lights; a pattern of lights, such as a moving arrow; a flashing of lights; a change in intensity of lights; a change in color of lights; a pulsing of lights; or a flickering of lights. The lighting effect associated with a value may be indicative of a range of the value. When the parameter has numerical values, the user may provide a list of ranges of values and a lighting effect to represent each range of the list. Thus, the display of the lighting effect may represent a range of the value of the parameter. The user, for example, may select a green display of a light for a first temperature range, a blue display for a second temperature range, violet for a third temperature range, red for a fourth temperature range, and white for a fifth temperature range. Thus, the color of the light display may indicate to the user the temperature range.

Alternatively, the user may provide for each range a beginning and end lighting effect. As the value of the parameter varies through the range, the lighting effect may vary from the beginning to the end effect. The result may be an almost continuous variation of the lighting effect with the value of the parameter. As an example, the intensity of a lighting effect or the pulse rate of a lighting effect representing a parameter may vary almost continuously with the value of the parameter. In such cases, the user may simply specify a single range of values and two lighting effects, one to represent the minimum value of the single range and the other to represent the maximum value of the single range. In such cases, the lighting effect may provide an accurate representation of the exact value of the parameter. As an example, a particular intensity of light or particular shade of color may indicate a value of a parameter within a very narrow range.

The lighting coordinator also receives from the user input on the representation of an attribute of a character or other aspect of a video game by another lighting effect at block 510. Based upon the user's input as described in block 505, the lighting coordinator may associate quantitative values of the parameter describing the state of the component with lighting effects at block 515. In some embodiments, the lighting coordinator may receive multiple associations of parameters with lighting effects and may store them in a data structure such as a table.

At block 520, the lighting coordinator receives a signal indicative of a value of the parameter from the component. The value of the parameter may be obtained by measurement. A temperature may, for example, be obtained by a thermistor. The value may be transmitted to the lighting coordinator by system management, which may read the value of the measurement. At block 525, the lighting coordinator receives data about the attribute of the character from the video game. In some embodiments, the manufacturer of the video game may provide an application programming interface that enables the operating system or other software of the information handling system to obtain the value from the video game.

At block 530, the lighting coordinator transmits control signals to one or more lights on the information handling systems to generate a lighting effect associated with the value of the parameter. In response to the control signals, at block 535 the one or more lights may generate the lighting effect in response to the control signals. As a result, the lighting effects may indicate to the user the range of a parameter of the component. The user may thus understand how near the information handling system is operating to machine limits.

At block 540, the lighting coordinator may transmit control signals to another light on the information handling systems to generate a lighting effect associated with a value of the attribute of the character. At block 545, the other light may generate the lighting effect associated with a value of the attribute of the character in response to the control signals. As a result, the lights may indicate to the user a state of the character, In some embodiments, method 500 may enable a video game player to stay informed of the operational state of the user's information handling system and the status of a character through the display of lights on the information handling system separate from the video display. As a result, scarce screen space may be devoted exclusively to details of the video game, and its use to keep track of the state of the components and of some of the character attributes may be avoided. Further, the lighting may provide more noticeable warnings than displays on the screen and enhance the user experience during gaming or other operation of the information handling system.

In an alternative embodiment, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device such as a video game controller, a network server or storage device, a switch router, wireless router, or other network communication device, a network connected device (cellular telephone, tablet device, etc.), or any other suitable device, and can vary in size, shape, performance, price, and functionality.

The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

The device or module can include software, including firmware embedded at a device, such as a Pentium class or PowerPC™ brand processor, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed:

1. A method comprising:

associating, via a lighting coordinator of an information handling system having a central processor, a memory, and a graphics interface, a range of quantitative values of a measured parameter that describes a state of operation of a component of the information handling system with a range of lighting effects of a lighting unit of the information handling system in a table, wherein the state of operation of the component of the information handling system includes an operating data load, a transmitted data load, a power draw, or a temperature level relevant to a current activity of the information handling system;

receiving a signal indicative of a quantitative value of the measured parameter by the lighting coordinator from the component;

transmitting to the lighting unit on the information handling system control signals to generate a lighting effect associated with the quantitative value of the measured parameter within the range of quantitative values, wherein the lighting effect associated with the quantitative values changes within the range of lighting effects in correlation to changes in the quantitative value; and generating, via a controller, the lighting effect by the lighting unit in response to the control signals.

2. The method of claim 1, wherein the lighting effect changes within the range of lighting effects in correlation to changes in the quantitative value within the associated range of quantitative values comprises varying the intensity of the lighting unit with a range of intensities based upon the quantitative values of the measured parameter.

3. The method of claim 1, wherein the lighting effect changes in correlation to changes in the quantitative value comprises morphing the lighting unit based upon the quantitative values of the measured parameter, wherein:

the morphing comprises cycling between two designated colors on the lighting unit within the range of lighting effects between the two designated colors; and the associating includes selecting the two designated colors and selecting a rate of cycling to indicate a measured parameter level for the state of operation.

4. The method of claim 1, wherein the lighting effect changes within the range of lighting effects in correlation to changes in the quantitative value comprises a pulsing of the lighting unit with a quantitative value of the measured parameter, including varying a rate of the pulsing within a range of pulsing rates.

5. The method of claim 1, wherein:

the lighting unit includes a light tube and two light-emitting diodes (LEDs), one LED at each end of the light tube; and the lighting effect changes within the range of lighting effects in correlation to changes in the quantitative value comprises a transitioning of the lighting unit with a quantitative value of the measured parameter, wherein the transitioning includes a display of a color at one of the LEDs at a first end of the light tube, a range of diffusion of the color through the light tube until it reaches the other end, and a display of the color at the LED at the other end.

6. The method of claim 1, further comprising receiving input from a user to configure the association of quantitative values of the measured parameter with the lighting effects.

7. The method of claim 6, wherein the input comprises a selection by the user of a package of lighting effects from a plurality of packages of lighting effects.

8. The method of claim 1, further comprising:

playing a video game on the information handling system; and associating an attribute of the video game with another lighting effect.

9. An information handling system comprising:

an operational indicator lighting unit;

a plurality of components including a central processor and a graphics processing unit (GPU);

a lighting coordinator to associate quantitative values of a measured parameter measured within a range of quantitative values of the measured parameter that describes a state of operation of a component of the information handling system with a range of lighting effects of the operational indicator lighting unit, wherein the state of operation of the component of the information handling system includes an operating data load, a transmitted data load, a power draw, or a temperature level relevant to a current activity of the information handling system;

the lighting coordinator to receive from the component a signal indicative of a quantitative value of the measured parameter;

the lighting coordinator to transmit control signals to the operational indicator lighting unit to generate the lighting effect within the range of lighting effects associated with the quantitative value of the measured parameter, wherein the lighting effect associated with the quantitative values within the range of quantitative values of the measured parameter changes in correlation to changes in the quantitative value; and the operational indicator lighting unit to display the lighting effect in response to the control signals.

10. The information handling system of claim 9, wherein the measured parameter comprises a processor power draw, a processor temperature, an indication of processor throttling, a percentage processor utilization, or an amount of utilization of the processor.

11. The information handling system of claim 9, wherein the measured parameter comprises a GPU power draw, a GPU temperature, an indication of GPU throttling, a percentage GPU utilization, or an amount of utilization of the GPU.

12. The information handling system of claim 9, wherein the measured parameter comprises a frame rate.

13. The information handling system of claim 9, wherein:

the operational indicator lighting unit includes a light tube and two light-emitting diodes (LEDs), one LED at each end of the light tube; and the lighting effect includes a display of a color at one of the LEDs at a first end of the light tube, a diffusion of the color through the light tube until it reaches the other end, and a display of the color at the LED at the other end.

14. The information handling system of claim 9, wherein a triangle shape is created on a case of the information handling system by a cut-out of the case, the triangle including three lighting units, wherein at least one of the lighting units is the operational indicator lighting unit.

15. The information handling system of claim 9, comprising a plurality of operational indicator lighting units including the operational indicator lighting unit, wherein:

the plurality of operational indicator lighting units are divided into zones; and for each zone, the lighting coordinator associates quantitative values of a measured parameter that describes a state of operation of a different component of the information handling system with lighting effects of the operational indicator lighting units of the zone.

16. An information handling system comprising:

an operational indicator lighting unit;

a plurality of components including a processor and a graphics processing unit (GPU);

a lighting coordinator to associate quantitative values of a measured parameter within a range of quantitative values of the measured parameter that describes a state of operation of the GPU with lighting effects of the operational indicator lighting unit within a range of lighting effects, wherein the state of operation of the GPU includes an operating data load, a transmitted data load, a power draw, or a temperature level relevant to a current activity of the GPU;

the lighting coordinator to receive from the GPU a signal indicative of a quantitative value of the measured parameter; and the lighting coordinator to transmit control signals to the operational indicator lighting unit to generate the lighting effect within the range of lighting effects associated with the quantitative value of the measured parameter, wherein the lighting effect associated with the quantitative values within the range of quantitative values of the measured parameter changes in correlation to changes in the quantitative value; and the operational indicator lighting unit to display the lighting effect in response to the control signals.

17. The information handling system of claim 16, wherein:

the measured parameter comprises a power draw, an ambient temperature, a percentage or amount of utilization, or a frame rate of the GPU; and the operational indicator lighting unit is to generate dynamic lighting effects in response to the control signals, thereby indicating a range of quantitative values of the measured parameter.

18. The information handling system of claim 16, further comprising:

a plurality of operational indicator lighting units, wherein the operational indicator lighting units are divided into zones; and a user interface to receive input from a user to configure, for each zone, an association of a lighting effect for the zone with quantitative values of a measured parameter for a component of the information handling systems.

19. The information handling system of claim 16, wherein the information handling system further comprises a video game indicator lighting unit to associate an attribute of a video game with lighting effects produced by the video game indicator lighting unit.

20. The information handling system of claim 18, wherein:

the information handling systems further comprises a plurality of operational indicator lighting units; and the lighting coordinator further comprises a plurality of drivers to transmit the control signals to the plurality of operational indicator lighting units.

* * * * *